US006474328B1

(12) United States Patent
Fells

(10) Patent No.: US 6,474,328 B1
(45) Date of Patent: Nov. 5, 2002

(54) HEATER UNIT

(76) Inventor: Anthony Crispin Fells, Sutton Cottage, Alston, Axminster, Devon EX13 7LG (GB)

( * ) Notice: Subject to any disclaimer, the term of this patent is extended or adjusted under 35 U.S.C. 154(b) by 0 days.

(21) Appl. No.: 09/597,191

(22) Filed: Jun. 20, 2000

(30) Foreign Application Priority Data

Jun. 21, 1999 (GB) ..... 9914454

(51) Int. Cl.[7] ..... F24H 3/08
(52) U.S. Cl. ..... 126/110 R; 126/116 A
(58) Field of Search ..... 126/110 R, 110 B, 126/110 D, 109, 104 R, 104 A, 116 R, 116 A; 431/156

(56) References Cited

U.S. PATENT DOCUMENTS

| | | | | |
|---|---|---|---|---|
| 3,828,762 A | | 8/1974 | Duzey | 126/91 A |
| 4,729,207 A | * | 3/1988 | Dempsey et al. | 126/110 R |
| 4,974,579 A | | 12/1990 | Shellenberger et al. | 126/110 R |
| 5,301,654 A | | 4/1994 | Weber, III et al. | 126/110 R |
| 5,437,263 A | * | 8/1995 | Ellingham et al. | 126/110 R |
| 5,601,071 A | * | 2/1997 | Carr et al. | 126/116 A |
| 5,775,318 A | | 7/1998 | Haydock et al. | 126/110 R |

FOREIGN PATENT DOCUMENTS

| | | |
|---|---|---|
| GB | 2091868 | 8/1982 |
| GB | 2208920 | 4/1989 |

* cited by examiner

*Primary Examiner*—Sara Clarke
(74) *Attorney, Agent, or Firm*—Haynes & Boone; Todd Mattingly

(57) ABSTRACT

A heater unit for air handling equipment comprises a peripheral frame 2 across which a plurality of heater tubes 12 extend. The heater tubes 12 have reverse bends, and each extends from an inlet end 6 and an exhaust end 8 disposed on the same side 10 of the frame 2. Respective burner units are provided at the inlet ends of the heater tubes 4. The exhaust ends 8 open into a common manifold from which the combustion gases generated by the burner units are evacuated by means of a fan.

The heater unit is suitable for installing in air handling equipment, for example to replace steam or electric heaters, with the frame 2 then serving as part of the ducting of the air handling equipment.

20 Claims, 6 Drawing Sheets

HEATER UNIT

CROSS REFERENCE TO RELATED APPLICATIONS

This application claims the benefit of British Patent Application No. 9914454.4, filed Jun. 21, 1999.

FIELD OF THE INVENTION

This invention relates to a heater unit and is particularly, although not exclusively, concerned with a heater unit which is adapted to be installed in the ducting of an air handling system.

BACKGROUND OF THE INVENTION AND PRIOR ART

Air handling systems commonly include equipment for heating, cooling, humidifying and otherwise conditioning the air passing through the system. Heating is commonly achieved by a heater unit comprising a peripheral frame across which heating elements extend in order to heat the air passing over them. The frame is of the same general dimensions as the surrounding ducting and serves as part of that ducting for the air passing over the heating elements. The elements themselves may be heated electrically or by steam.

It is known to install gas fired heaters in air handling systems. However, such heaters are usually substantially smaller in flow cross-section than the ducting itself and so the air has to be fed to, and drawn from, the unit heaters by means of convergent and divergent ducting. This restriction in flow cross-section has the effect of increasing the load on the fan drawing air through the system. Nevertheless, the use of gas-fired burners (or indeed burners using other forms of fuel) tends to be more efficient than electric heaters or those using steam.

Furnaces or space heaters are known from, for example, U.S. Pat. No. 4,974,579 (Shellenberger), U.S. Pat. No. 5,301,654 (Weber) and U.S. Pat. No. 5,775,318 (Haydock), in which air to be heated passes over a plurality of heater tubes. Each heater tube has a burner at an inlet end and an exhaust end which discharges to a flue. Thus burning of a fuel, such as gas, takes place in the heater tubes, and heat from the combustion gases is transferred to the air to be heated.

Such furnaces or space heaters are not suitable for mounting in an air handling system. This is because they are bulky, and so cannot be fitted in the relatively narrow space which tends to be allowed for electric or steam heater units. Furthermore, the known furnaces and space heaters do not provide a straight path for the air to be heated, and so they cannot be mounted in line in an air heating system.

BRIEF DESCRIPTION OF THE INVENTION

According to the present invention there is provided a heater unit comprising a peripheral frame having an inlet and an outlet disposed opposite each other. A plurality of heater tubes extend across the frame, each heater tube having an inlet end and an outlet end. A respective burner unit is disposed at the inlet end of each heater tube, and a common manifold unit is provided into which opens the outlet end of each burner tube.

Such a heater unit can be installed in an air handling system, with the peripheral frame serving as part of the ducting of the system. Air flowing through the frame can thus be heated efficiently as it passes over the heater tubes.

Preferably, the heater tubes extend substantially across the full width of the peripheral frames. The tubes may include one or more reverse bends in order to increase the effective length of the heater tube within the frame. The frame is preferably rectangular, in which case the inlet and exhaust ends of the heater tubes may be provided on the same side of the frame.

A fan may be provided to draw the combustion products of the burner units through the heater tubes, and this fan may be positioned to extract these combustion products from the manifold.

The diameter of each heater tube may be greater at the inlet end than at the exhaust end. For example, where each heater tube has one or more reverse bends, the length of the heater tube approximately up to the first reverse bend may be of a larger diameter than the remainder of that heater tube.

It is preferable for the length of the heater unit, in the direction of air flow through the peripheral frame, to be kept as small as possible. This length is therefore preferably not more than 50% and more preferably not more than 25% of the length of the longer side of the peripheral frame, when the frame is rectangular.

Another aspect of the present invention provides air handling equipment including ducting and a heater unit as defined above, the peripheral frame of the heater unit comprising part of the ducting.

In accordance with a third aspect of the present invention, there is provided a method of modifying air handling equipment having a heater which includes a peripheral frame forming part of the ducting of the air handling equipment, the method comprising removing the existing heater and replacing it with a heater unit as defined above.

DETAILED DESCRIPTION OF PREFERRED EMBODIMENTS

Figure 1:
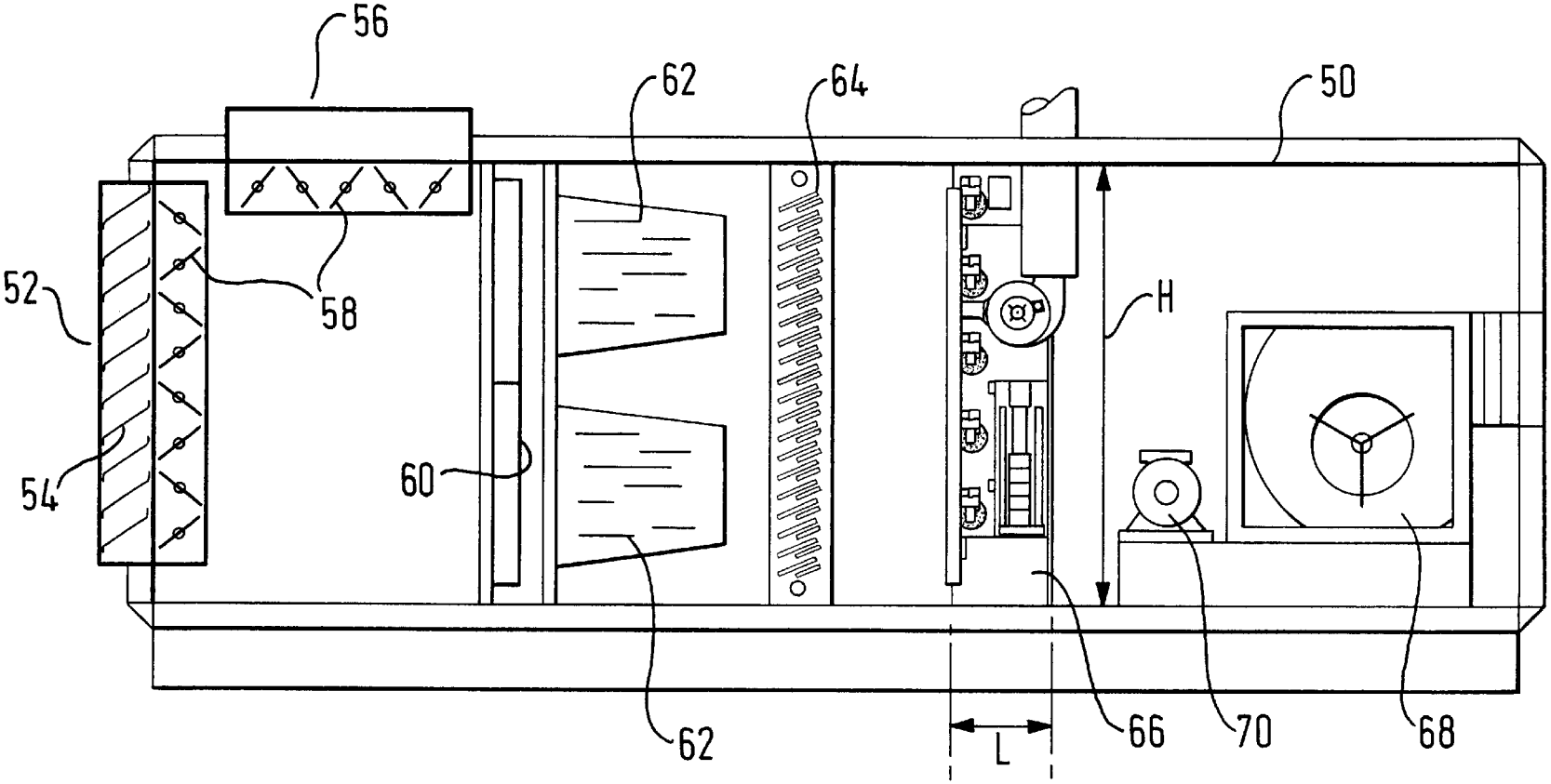
FIG. 1 is a side view of an air handling unit.

The air handling unit shown in FIG. 1 comprises ducting 50. The ducting is of generally rectangular cross-section, and one side wall is omitted from FIG. 1 so that the internal components of the ducting are shown.

The ducting 50 has an end inlet opening 52, provided with louvers 54, and a top opening 56. The openings 52 and 56 are provided with dampers 58. Panel filters 60 and bag filters 62 are provided to remove particulates from the air flow. Downstream of the filters 60 and 62 there is a cooling coil 64, followed by a heater unit 66. Towards the outlet of the ducting 50 there is a fan 68 driven by a motor 70. Fan 68 serves to draw air through the air ducting 50, and discharge it to further ducting for delivery to spaces which are to receive conditioned air.

Figure 2:
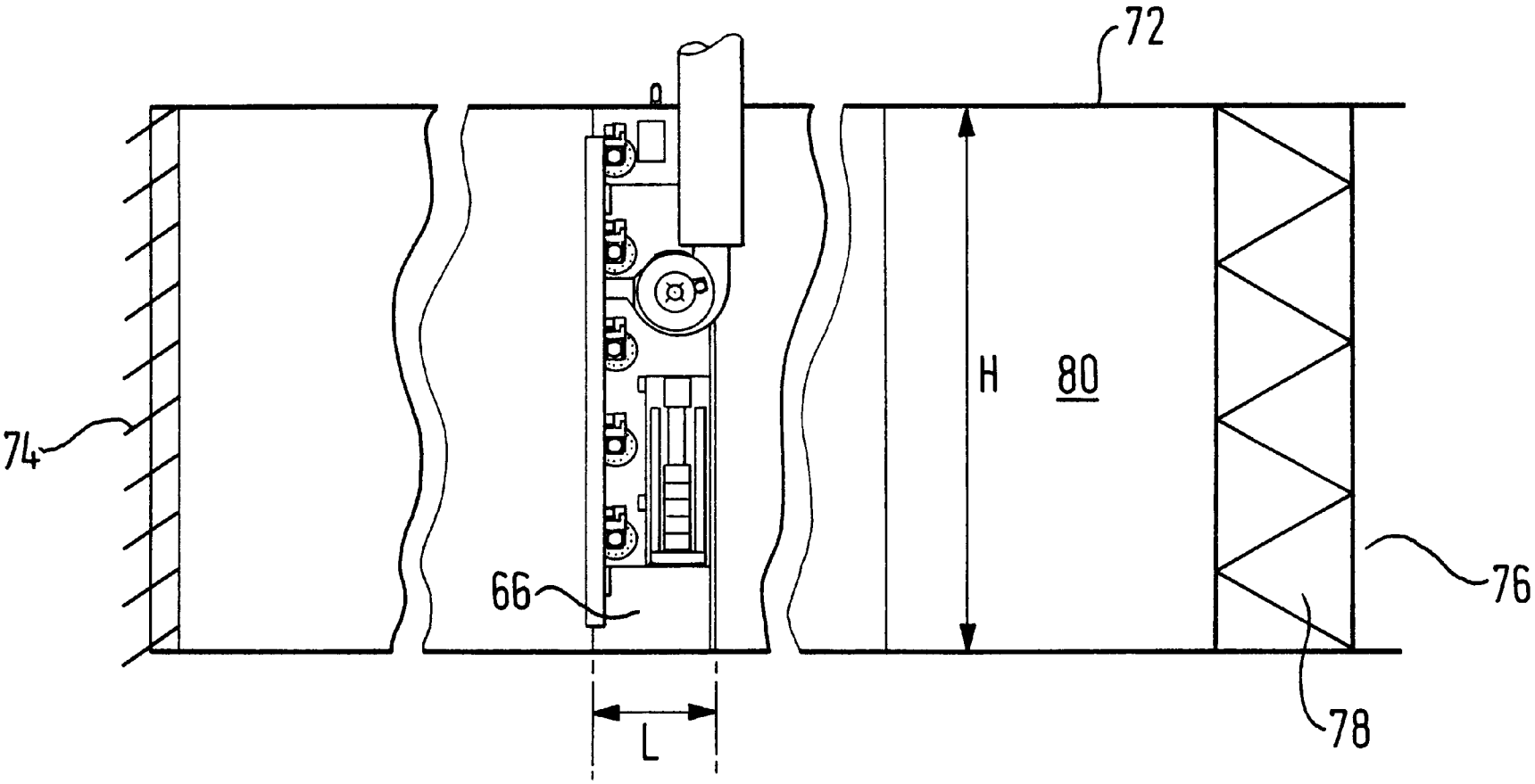
FIG. 2 is a side view of a duct heater.

FIG. 2 shows a ducted heater. This heater comprises ducting 72, which may be of any length, extending from a louvered inlet 74 to an outlet 76 provided with a filter 78. A fan (not shown) is provided in the region 80 immediately upstream of the filter 78. The ducting 72 also accommodates a heater unit 66 which corresponds to that shown in FIG. 1.

In the unit shown in FIGS. 1 and 2, it will be appreciated that the length of the heater unit 66 (indicated by the arrows L in FIGS. 1 and 2) is relatively small in relation to the height of the ducting 50, 72 (indicated by the arrow H in FIGS. 1 and 2). In the embodiments OF FIGS. 1 and 2, the height H represents the minimum cross-sectional dimension of the ducting 50, 72.

This narrow width of the heater unit 66 enables the unit to be installed within a space formerly occupied by a heater unit heated by electricity or steam. Consequently, the heater unit 66, although utilizing gas, can be installed as a replacement for an electric or steam heater.

The heater unit 66 is described in greater detail with reference to FIGS. 3 to 7 below.

Figure 3:
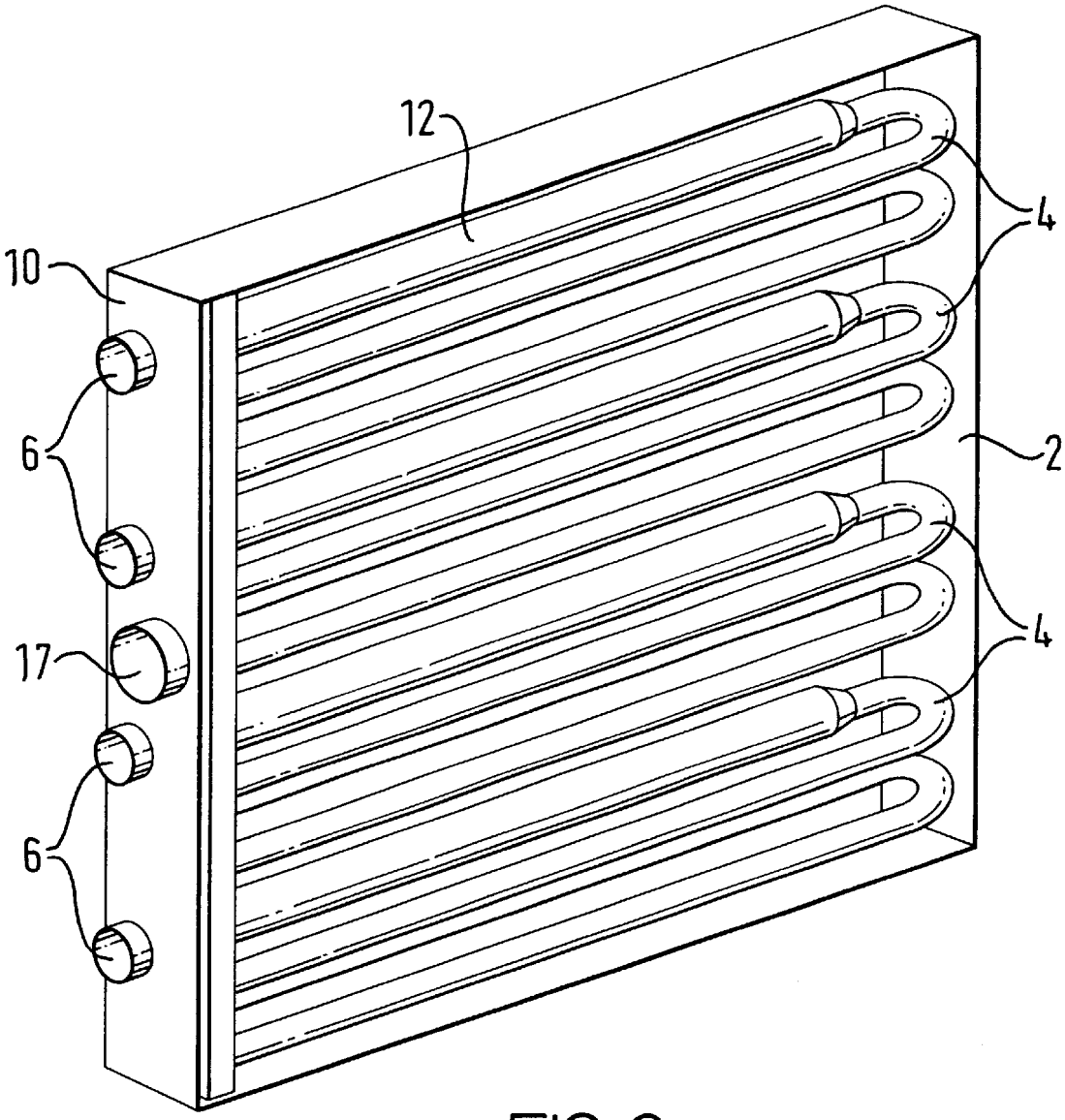
FIG. 3 is a diagrammatic perspective view of a heater unit for use in the air handling unit of FIG. 1 or the duct heater of FIG. 2.

The heater unit shown in FIG. 3 comprises a peripheral frame 2 fabricated from sheet metal. Within the frame 2 are disposed a plurality of heater tubes 4. In the diagrammatic view shown in FIG. 3, there are four such heater tubes, whereas in the embodiment shown in FIGS. 4 to 6, there are five of the heater tubes 4.

Each heater tube 4 extends from an inlet end 6 to an exhaust end 8. All of the inlet ends 6 and exhaust ends 8 are situated on a common side wall 10 of the peripheral frame 2. Although not shown, the heater tubes 4 may be finned to assist heat transfer.

Between the inlet end 6 and exhaust end 8, each heater tube 4 has three reverse bends, providing four runs of the heater tube. Each run extends substantially the full width of the peripheral frame 2. The heater tube run 12 extending from the inlet end 6 is of a larger diameter than the subsequent runs.

Figure 4:
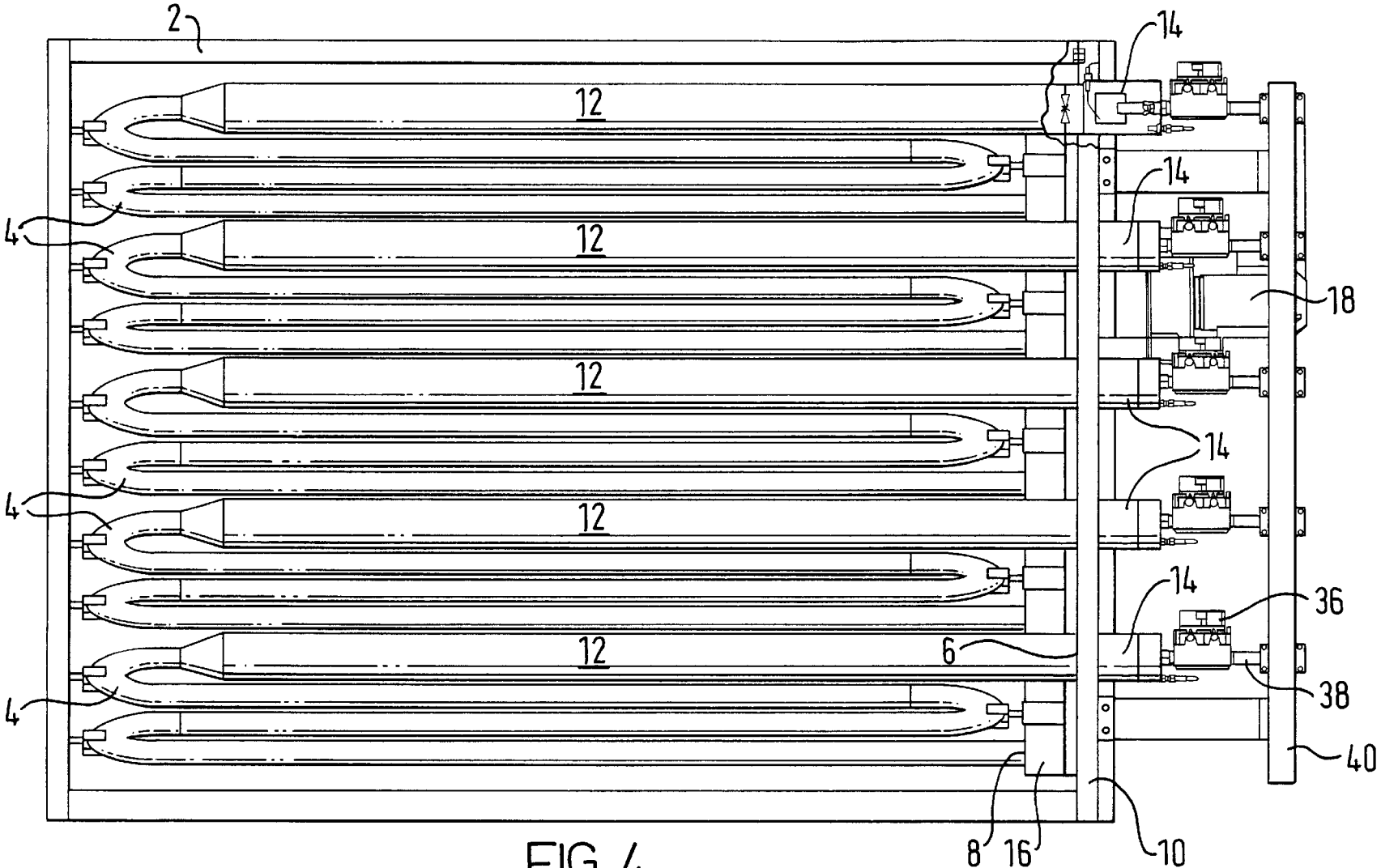
FIG. 4 is an end view of the heater unit of FIG. 3.
Figure 5:
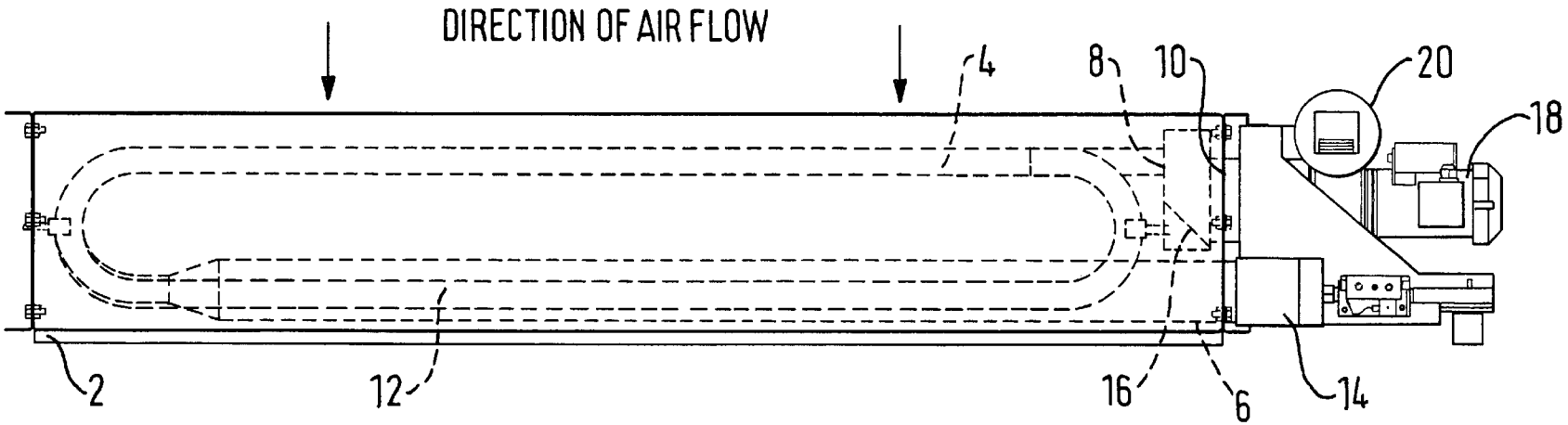
FIG. 5 is a plan view of the heater unit.

As shown in FIG. 4, a burner unit 14 is provided at the inlet end 6 of each heater tube. The burner unit 14 is positioned so that, in operation, the combustion gases which are generated are directed into the heater tube 4. The exhaust ends 8 of the heater tubes communicate with a common manifold 16 which extends along the inside of the side 10 of the frame 2. The manifold 16 has an outlet 17 connected to a fan 18 mounted on the side 10 to draw combustion gases from the manifold 16 and to feed them to a flue 20 (FIG. 5).

Figure 6:
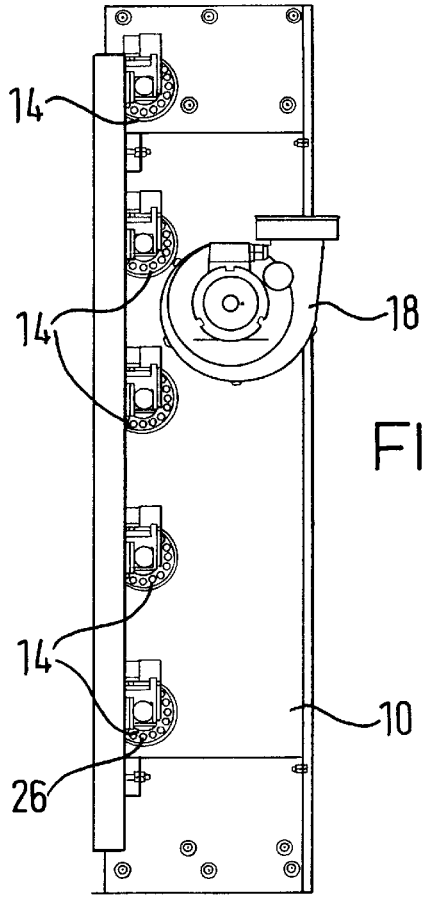
FIG. 6 is a side view of the heater unit.
Figure 7:
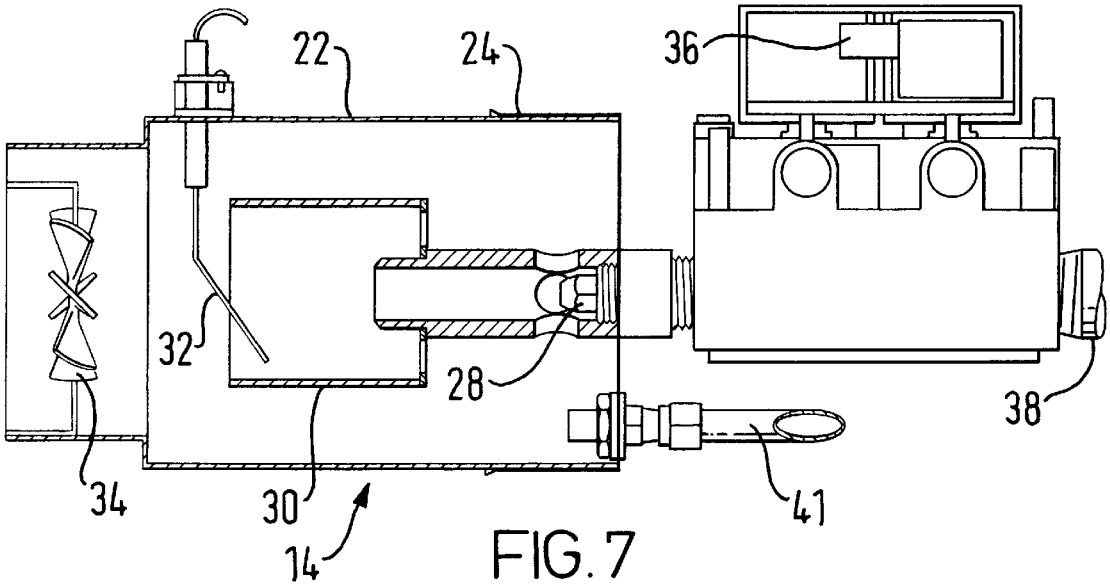
FIG. 7 is an enlarged view of a burner unit of the heater unit.

FIG. 7 shows one of the burner units 14. The burner unit comprises an air tube 22 which is closed at one end by a cap 24 having a series of air holes 26 (FIG. 6). A gas injecter 28 is disposed centrally on the cap 24 and is surrounded by a burner head 30. An ignition electrode 32 projects into the burner head 30.

A stationary swirler 34 is supported within the burner tube 22 downstream of the burner head 30. Gas flow to the injecter 28 is controlled by means of a regulator 36. Gas is supplied to the regulator 36 through a pipe 38 branched from a gas manifold 40 (FIG. 4).

A pipe 41 connects the interior of the air tube 22 to an air pressure switch (not shown) to monitor air flow into the burner unit to ensure that this flow is sufficient for correct combustion.

For use, the heater unit 66 is installed in the ducting 50, 72 of air handling equipment shown in FIG. 1 or the duct heater shown in FIG. 2.

In the embodiment of FIG. 1, the frame 2 is a close fit within the ducting 50 so that air flow through the ducting 50 is directed through the frame 2 with minimum disturbance. In the embodiment of FIG. 2, the frame 2 serves as part of the ducting 72. Thus, the frame 2 has the same cross-sectional shape and dimensions as the remainder of the ducting 50, 72 so that air flow through the heater unit 66 can take place without any narrowing of the ducting cross-section. For example, the rectangular frame 2 may be 1800 mm wide and 1400 mm high (dimension H in FIGS. 1 and 2). The length L of the frame, in the direction of air flow, may be 325 mm.

A heater unit as described above can thus serve as an economic replacement in an air handling system for heaters utilising steam or electricity. Fitting a heater unit as described above involves minimal disruption to the air handling equipment as a whole.

What is claimed is:

1. A heater unit comprising:

a peripheral frame having an inlet and an outlet disposed opposite each other;

a plurality of heater tubes extending across the frame, each heater tube having an inlet end and an outlet end;

a respective burner unit disposed at the inlet end of each heater tube, each burner unit being provided with a respective regulator for controlling the supply of fuel to that burner unit;

a common manifold unit into which opens the outlet end of each heater tube.

2. The heater unit of claim 1, in which the diameter of each heater tube adjacent its inlet end is greater than the diameter adjacent the outlet end.

3. The heater unit of claim 1, in which each heater tube includes a reverse bend, whereby the heater tube includes first and second runs interconnected by the reverse bend.

4. The heater unit of claim 3, in which the first run of each heater tube extends from the inlet end to the reverse bend and has a larger diameter than the second run of that heater tube.

5. The heater unit of claim 1, in which the peripheral frame defines a rectangular opening in which the heater tubes are situated.

6. The heater unit of claim 5, in which the inlet and outlet ends of the heater tubes are all disposed on one side of the frame.

7. The heater unit of claim 1, in which a fan is provided to draw combustion gases through the heater tubes.

8. The heater unit of claim 7, in which the fan is connected to an outlet of the common manifold.

9. The heater unit of claim 1, in which there are three or more of the heater tubes.

10. The heater unit of claim 1, in which the peripheral frame has a length extending between the inlet and the outlet and a minimum transverse dimension measure perpendicular to the length, the length being not more than 50% of the minimum transverse dimension of the frame.

11. The heater unit of claim 10, in which the length of the peripheral frame is not more than 25% of the minimum transverse dimension of the frame.

12. A heater unit comprising:

a rectangular peripheral frame having an inlet and an outlet disposed opposite each other, the frame having a length dimension between the inlet and the outlet and having a minimum transverse dimension perpendicular to the length dimension, the length dimension being not more than 50% of the minimum transverse dimension;

at least three heater tubes extending across the frame in a first direction, each heater tube having an inlet end and an outlet end, the heater tubes being disposed in a single row which extends across the peripheral frame in a second direction perpendicular to the first direction, each heater tube including a reverse bend, whereby the heater tube includes first and second runs interconnected by the reverse bend;

a respective burner unit disposed at the inlet end of each heater tube, each burner unit being provided with a respective regulator for controlling the supply of fuel to that burner unit;

a common manifold unit into which opens the outlet end of each heater tube.

13. The heater unit of claim 12, in which the diameter of each heater tube adjacent its inlet end is greater than the diameter adjacent the outlet end.

14. The heater unit of claim 12, in which the first run of each heater tube extends from the inlet end to the reverse bend and has a larger diameter than the second run of that heater tube.

15. The heater unit of claim 12, in which the inlet and outlet ends of the heater tubes are all disposed on one side of the frame.

16. The heater unit of claim 12, in which a fan is provided to draw combustion gases through the heater tubes.

17. The heater unit of claim 16, in which the fan is connected to an outlet of the common manifold.

18. The heater unit of claim 12, in which the length dimension of the peripheral frame is not more than 25% of the minimum traverse dimension of the frame.

19. Air handling equipment comprising first and second ducting portions and a heater unit mounted between the ducting portions, the heater unit comprising:

a peripheral frame having an inlet and an outlet disposed opposite each other, the peripheral frame extending between the first and second ducting portions;

a plurality of heater tubes extending across the frame, each heater tube having an inlet end and an outlet end;

a respective burner unit disposed at the inlet end of each heater tube, each burner unit being provided with a respective regulator for controlling the supply of fuel to that burner unit;

a common manifold unit into which opens the outlet end of each heater tube.

20. A method of modifying air handling equipment comprising ducting and a heater unit mounted in the ducting, the heating unit providing a heating effect by means selected from electricity and steam, the method comprising replacing the heater unit by a replacement heater unit comprising:

a peripheral frame having an inlet and an outlet disposed opposite each other, the peripheral frame being installed in the ducting;

a plurality of heater tubes extending across the frame, each heater tube having an inlet end and an outlet end;

a respective burner unit disposed at the inlet end of each heater tube, each burner unit being provided with a respective regulator for controlling the supply of fuel to that burner unit;

a common manifold unit into which opens the outlet end of each heater tube.

* * * * *